US007207127B2

(12) United States Patent
Rohr

(10) Patent No.: US 7,207,127 B2
(45) Date of Patent: Apr. 24, 2007

(54) HOOK-ON GRAB BUCKET, IN PARTICULAR MOTOR-DRIVEN UNDERWATER GRAB BUCKET

(75) Inventor: Wolfgang Rohr, Speyer (DE)

(73) Assignee: Wolfgang Rohr GmbH & Co. KG, Waldsee (DE)

( * ) Notice: Subject to any disclaimer, the term of this patent is extended or adjusted under 35 U.S.C. 154(b) by 300 days.

(21) Appl. No.: 10/886,224

(22) Filed: Jul. 6, 2004

(65) Prior Publication Data

US 2005/0000124 A1 Jan. 6, 2005

(30) Foreign Application Priority Data

Jul. 3, 2003 (DE) ..... 203 10 240 U

(51) Int. Cl.
*E02F 3/76* (2006.01)

(52) U.S. Cl. ..... 37/308; 37/340; 37/187; 414/730

(58) Field of Classification Search ..... 37/307–309, 37/316, 461, 340–342, 184–188, 348, 382; 294/68.23; 701/50; 414/729, 730, 141.2, 414/186, 618

See application file for complete search history.

(56) References Cited

U.S. PATENT DOCUMENTS 5,443,294 A * 8/1995 Prinz et al. ..... 294/68.23
5,553,404 A * 9/1996 Bergeron ..... 37/184
6,134,815 A 10/2000 Rohr
6,185,493 B1 2/2001 Skinner et al.
6,331,772 B1 12/2001 Windte et al.

FOREIGN PATENT DOCUMENTS

DE 2110352 * 9/1972
DE 196 48 335 C2 6/1998
DE 100 07 433 A1 9/2000
EP 0 937 675 A1 8/1999

* cited by examiner

*Primary Examiner*—Thomas A Beach
(74) *Attorney, Agent, or Firm*—Laurence A. Greenberg; Werner H. Stemer; Ralph E. Locher

(57) ABSTRACT

A grab bucket, in particular motor-driven underwater grab bucket, has first and second half-scoops. The scoops can be moved relative to on another from an open position into a closed position by a hydraulic cylinder. The opening angle of the half-scoops is monitored by a sensor which is connected to a control and monitoring device. The sensor is integrated in the hydraulic cylinder and generates an actuating-travel signal which corresponds to the actuating travel of the hydraulic cylinder.

12 Claims, 3 Drawing Sheets

HOOK-ON GRAB BUCKET, IN PARTICULAR MOTOR-DRIVEN UNDERWATER GRAB BUCKET

BACKGROUND OF THE INVENTION

Field of the Invention

The invention relates to a hook-on grab bucket, in particular an motor-driven underwater grab bucket. The device has first and second half-scoops which can be moved relative to one another from an open position into a closed position by way of an hydraulic cylinder. The opening angle of the half-scoops is monitored by a sensor, which is connected to a control and monitoring device.

Hook-on grab buckets are generally used for removing material being excavated, such as gravel, sand or other soil, from a relatively great depth of up to 100 meters or more, for example for obtaining gravel from excavation ponds. For that purpose, the hook-on grab buckets are designed as "motor-driven underwater grab buckets."

The hook-on grab buckets have a first and second half-scoop which can be opened and closed relative to each other by means of one or more hydraulic cylinders, the hydraulic cylinders being driven by an electric motor, which is fitted on the grab bucket, and a hydraulic pump, which is driven by the motor, and an associated control device.

In the case of the prior art hook-on grab buckets, in particular in the case of motor-driven underwater grab buckets, the problem arises that, although the excavator driver can bring about the opening and closing of the half-scoops from the driver's cab of the excavator by means of corresponding operating elements, the operator cannot visually monitor the closing process as such, since the motor-driven underwater grab bucket is generally below the water surface during the closure of the half-scoops. The absence of the possibility for visual monitoring has the consequence that the half-scoops are not completely closed or may become distorted due to the high closing forces generated by the hydraulic cylinders if the movement of the two half-scoops is blocked by hard objects, such as, for example, wood or rocks, which pass between the half-scoops.

In order to counteract this problem, I have previously disclosed in my commonly assigned U.S. Pat. No. 6,134,815 and European patent EP 0 937 675 B1 equipping motor-driven underwater grab buckets with a monitoring device in which the opening angle of the half-scoops is detected by a rotation angle sensor and transferred via a bus system to a control and monitoring device which illustrates the closing position of the half-scoops on a screen in the driver's cab of the excavator. The excavator operator can recognize if the half-scoops have been incompletely closed and can initiate corresponding countermeasures.

The graphical reproduction of the closing position of the half-scoops enables the efficiency when removing the material being excavated to be considerably improved in the above-mentioned device. However, the rotation angle sensor, which is arranged in the region of the end sides of the pivot axis of the half-scoops, makes it virtually impossible to detect a distortion of the half-scoops caused by the system, with the result that damage to the half-scoops cannot be reliability counteracted. In addition, the rotation angle sensors are susceptible to damage which may be caused, in particular, by the material being excavated, for example clay or foreign bodies in the form of large stones and even trees, or by the hook-on grab bucket overturning in the case of excavators which are in the region of slopes.

SUMMARY OF THE INVENTION

It is accordingly an object of the invention to provide a grab bucket, in particular a motor-driven underwater grab bucket, which overcomes the above-mentioned disadvantages of the heretofore-known devices and methods of this general type.

With the foregoing and other objects in view there is provided, in accordance with the invention, a hook-on grab bucket, comprising:

- first and second half-scoops movably disposed relative to one another between an open position and a closed position;
- an hydraulic cylinder for moving the first and second half-scoops between the open position and the closed position;
- a sensor disposed to monitor an opening angle of the half-scoops, the sensor being integrated in the hydraulic cylinder and generating an actuating-travel signal corresponding to an actuating travel of the hydraulic cylinder; and
- a control and monitoring device connected to receive the actuating-travel signal from said sensor.

In other words, a hook-on grab bucket comprises a first and a second half-scoop that can be pivoted relative to each other from an open position into a closed position by means of at least one hydraulic cylinder. The cylinder is braced on the grab-bucket base and on the particular half-scoop. The grab-bucket base is held in a known manner on steel cables which are held by a crane or excavator. Furthermore, the grab bucket may likewise be designed as a cactus grab bucket which is actuated by one or more hydraulic cylinders.

The opening angle of the half-scoops is monitored by a sensor which is connected to an electronic control and monitoring device and is integrated in the hydraulic cylinder in the manner according to the invention, and generates an actuating-travel signal which corresponds to the actuating travel of the hydraulic cylinder and is transferred via a known bus system, for example a PROFIBUS bus system (see: www.profibus.com) to the control and monitoring device which is situated, for example, in a protected manner in the driver's cab of the excavator.

In accordance with a preferred embodiment of the invention, the sensor is advantageously a magnetostrictive sensor which comprises a bar-shaped sensor element that runs within the piston rod of the hydraulic cylinder, and that interacts with a measuring sensor in the form of a positioning magnet which is fastened to the piston rod of the hydraulic cylinder and moves together with it.

Magnetostrictive sensors of this type are based on the known magnetostrictive measuring principle, in which a current pulse within the bar-shaped sensor element generates a magnetic field which interacts with the positioning magnet, which is arranged annularly around the bar-shaped sensor element, and generates a mechanical wave which propagates along the bar-shaped sensor element at the speed of sound. In this case, the measuring sensor determines the propagation time of the wave from the positioning magnet to the measuring sensor, which time, owing to the constancy of the propagation speed of sound in the sensor element, is proportional to the distance between the measuring sensor and the positioning magnet. Since the positioning magnet is advantageously arranged directly at the upper end of the piston rod of the hydraulic cylinder, the signal generated by the sensor element corresponds essentially to the actuating travel by which the piston has been displaced within the hydraulic cylinder. The signal is also referred to below as the actuating-travel signal and is essentially proportional to the actuating travel covered by the piston rod in the hydraulic cylinder.

The device according to the invention affords the advantage that the actuating position of the first and second half-scoops can be determined with very great accuracy and reliability owing to the comparatively long actuating travels of the hydraulic cylinders. In this case, it is particularly advantageous that the sensor cannot be brought out of alignment or even be damaged by the material being excavated, for example if the grab bucket overturns on an obliquely running slope, if the hook-on grab bucket is lowered into a stony underlying surface or if it is lowered onto large foreign bodies, since the hydraulic cylinders as such are additionally protected by corresponding protective plates on the grab bucket base.

A further advantage of the device according to the invention resides in the fact that, in contrast to known hook-on grab buckets, in which rotation angle sensors are used, the actuating position of the half-scoops can be determined with considerably higher accuracy, since the engagement points of the hydraulic cylinders or their piston rods on the half-scoops are situated a comparatively long way away from the pivot point of the half-scoops, and accordingly the absolute adjusting path along which the measurement takes place is much larger.

As the applicant has discovered, this results for the first time in practice in the possibility, when two or even four hydraulic cylinders with sensors contained in them are used, of reliably determining the distortion of the half-scoops when they grasp large objects, in order to be able to initiate in good time appropriate countermeasures which may consist, for example, in the movement of the grab bucket being stopped by a corresponding interruption in the supply of hydraulic fluid. The switching off preferably takes place automatically by means of the control and monitoring device without the excavator driver having to be active himself.

A further advantage of the device according to the invention can be seen in the fact that the actuating position can also be recalibrated very easily when bearing bushings are worn out, when cutting edges of the grab bucket are worn and/or when half-scoops are distorted, with sufficient accuracy for the closing position still being maintained even if the bearings of the half-scoops are worn out to a comparatively severe degree, since the bearing clearance occurring in the range of a few millimeters is considerably smaller than the actuating travel of the hydraulic cylinders that usually lies in the region of a few hundred millimeters.

In the preferred embodiment of the invention, provision may be made for the control and monitoring device to compare the opening angle of the half-scoops with a predefined desired value, and to automatically correct the actuating position of the half-scoops or of the worn cutting edges of the grab bucket if the deviation between the opening angle and the predefined, preferably digitally stored desired value, exceeds a predefined threshold value.

According to a further refinement of the invention, the actual opening angle of the half-scoops is calculated by the control and monitoring device using the actuating-travel signal of the sensor or the sensors, and is illustrated in the driver's cab of the excavator on a display device, which is connected to the control and monitoring device, in the form of a graphic representation.

In the case of the preferred embodiment of the invention, at least two hydraulic cylinders with sensors contained in them are used, the control and monitoring device preferably comparing the actuating-travel signals of the two hydraulic cylinders with each other and stopping the movement of the half-scoops into the closed position if the difference between the actuating-travel signals exceeds a predefined threshold value. The two actuating-travel signals are preferably compared in the case of hydraulic cylinders which engage together on one half-scoop.

Furthermore, provision may be made for all of the customary four hydraulic cylinders that are used of a hook-on grab bucket to be provided with corresponding sensors, and for the differences between the actuating-travel signals of all of the cylinders to be determined relative to one another in order to initiate an emergency stop or to output an acoustic warning signal if one of the differences exceeds the predefined threshold value. This affords the advantage that a distortion of the half-scoops, as can frequently be observed in the case of the hook-on grab buckets of the prior art when they are used on a stony or rocky underlying surface or when they grasp large foreign bodies, such as erratic boulders or trees, can very reliably be avoided at an early stage.

According to a further embodiment of the invention, provision may alternatively or also additionally be made for the control and monitoring device to determine from the actuating-travel signals of one, of two, or of all four cylinders of the hook-on grab bucket, the associated actuating speeds of the cylinders—i.e., strictly speaking, of the piston rods in the cylinders, and to stop the movement of the half-scoops during the closing process if the difference between the actuating speeds of the hydraulic cylinders exceeds a predefined threshold value or one of the actuating speeds drops below a predefined minimum value for the actuating speed. This minimum value for the actuating speed can lie, for example, in the region of a few mm per second. The speed can be obtained here by a temporal differentiation of the actuating-travel signal supplied by the sensor or the sensors in the hydraulic cylinders, and is calculated preferably constantly and automatically by the control and monitoring device.

Other features which are considered as characteristic for the invention are set forth in the appended claims.

Although the invention is illustrated and described herein as embodied in a hook-on grab bucket, in particular motor-driven underwater grab bucket, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
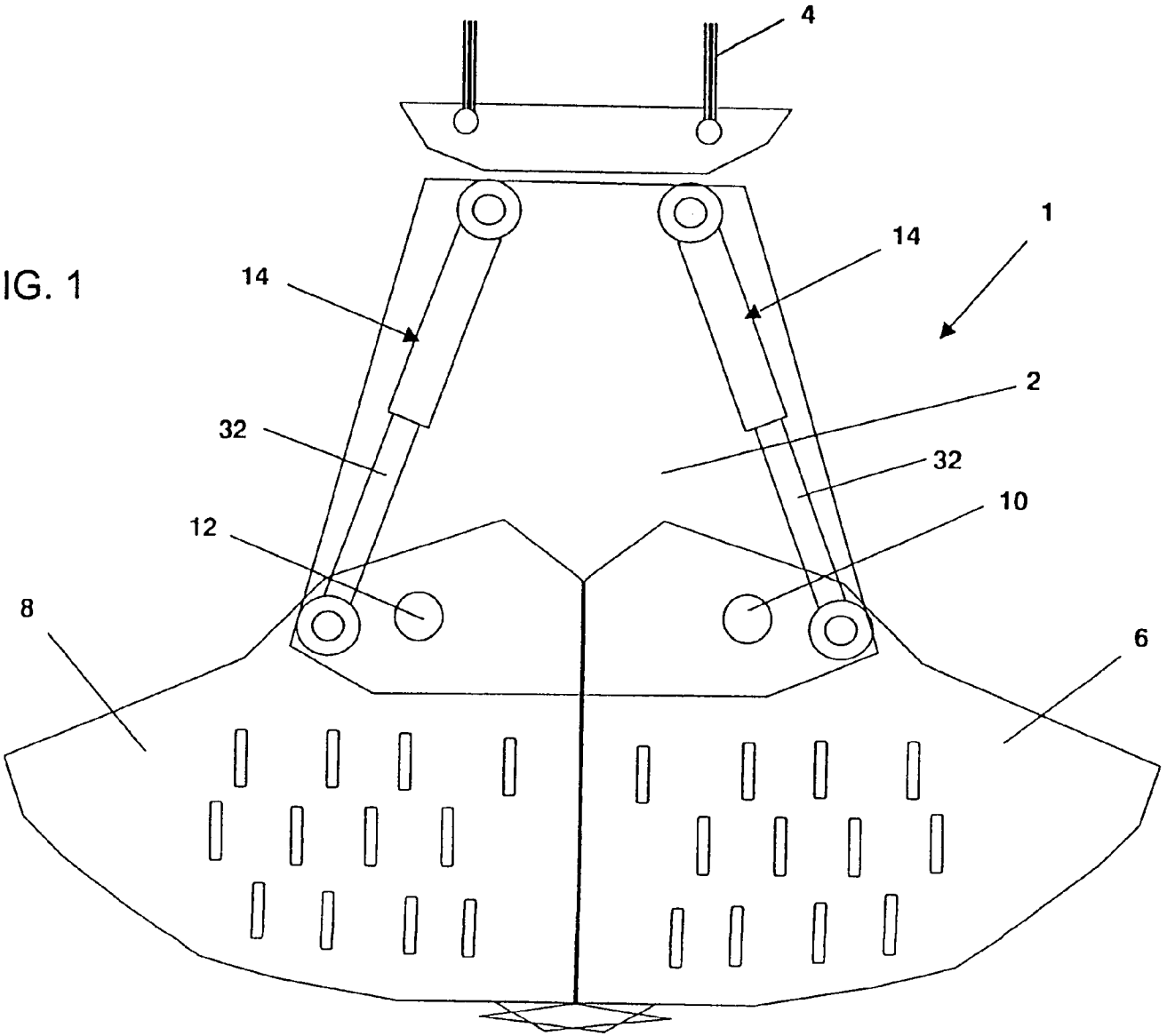
FIG. 1 is a side view of a grab bucket according to the invention in the closed position.

Referring now to the figures of the drawing in detail and first, particularly, to FIG. 1 thereof, there is shown a hook-on grab bucket 1 according to the invention. The grab bucket has a base 2 which is suspended from steel cables 4 on a non-illustrated crane or an excavator boom.

Figure 2:
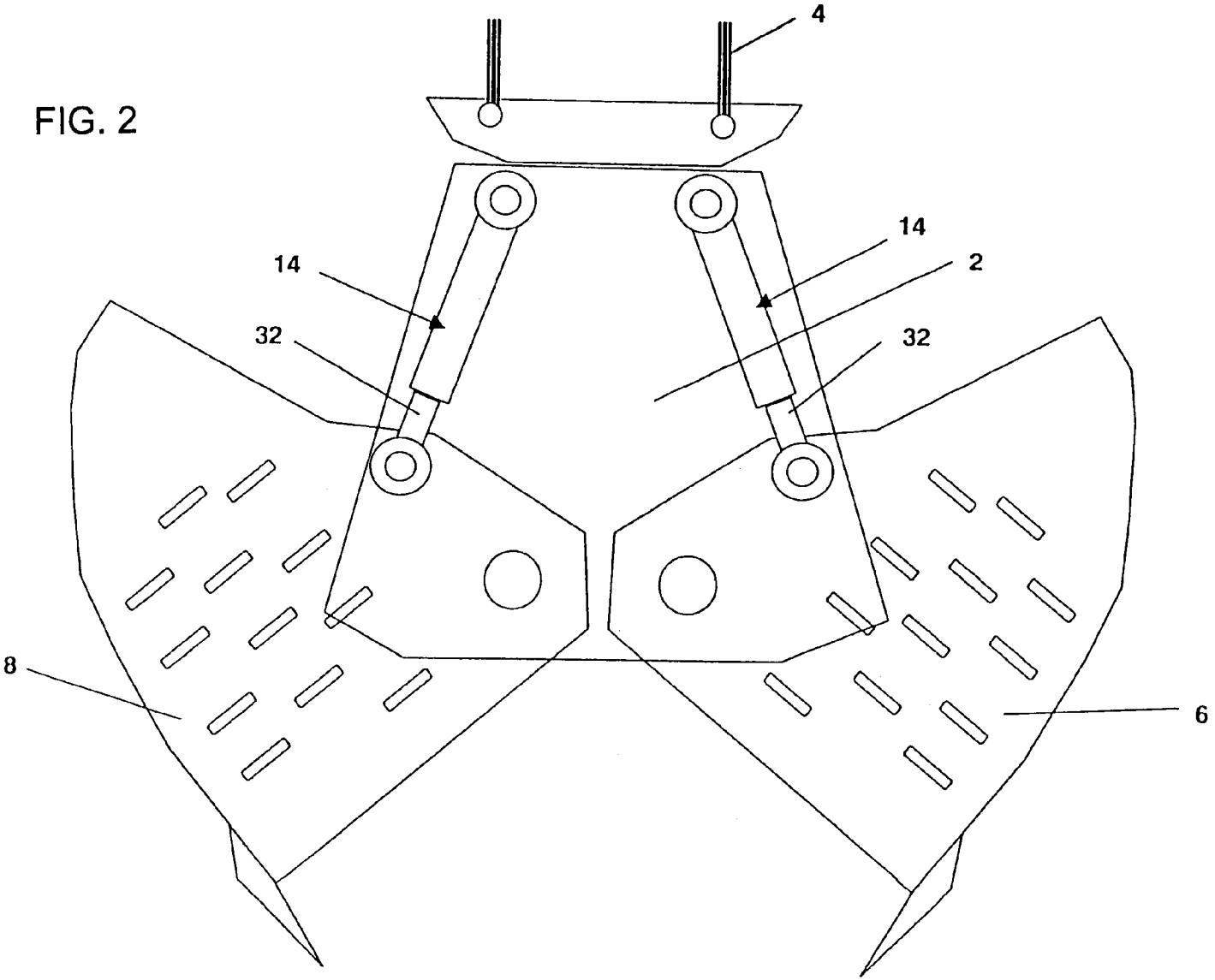
FIG. 2 is a side view of the grab bucket in the open position.

A first half-scoop 6 and a second half-scoop 8 are held on the basic body 2 in a manner such that they can pivot about associated pivot axes 10, 12. It is possible for the half-scoops 6, 8 to be moved from the open position, which is shown in FIG. 2, into the closed position, which is shown in FIG. 1, and back by means of hydraulic cylinders 14 acting between the particular half-scoops and the grab bucket base 2.

Figure 3:
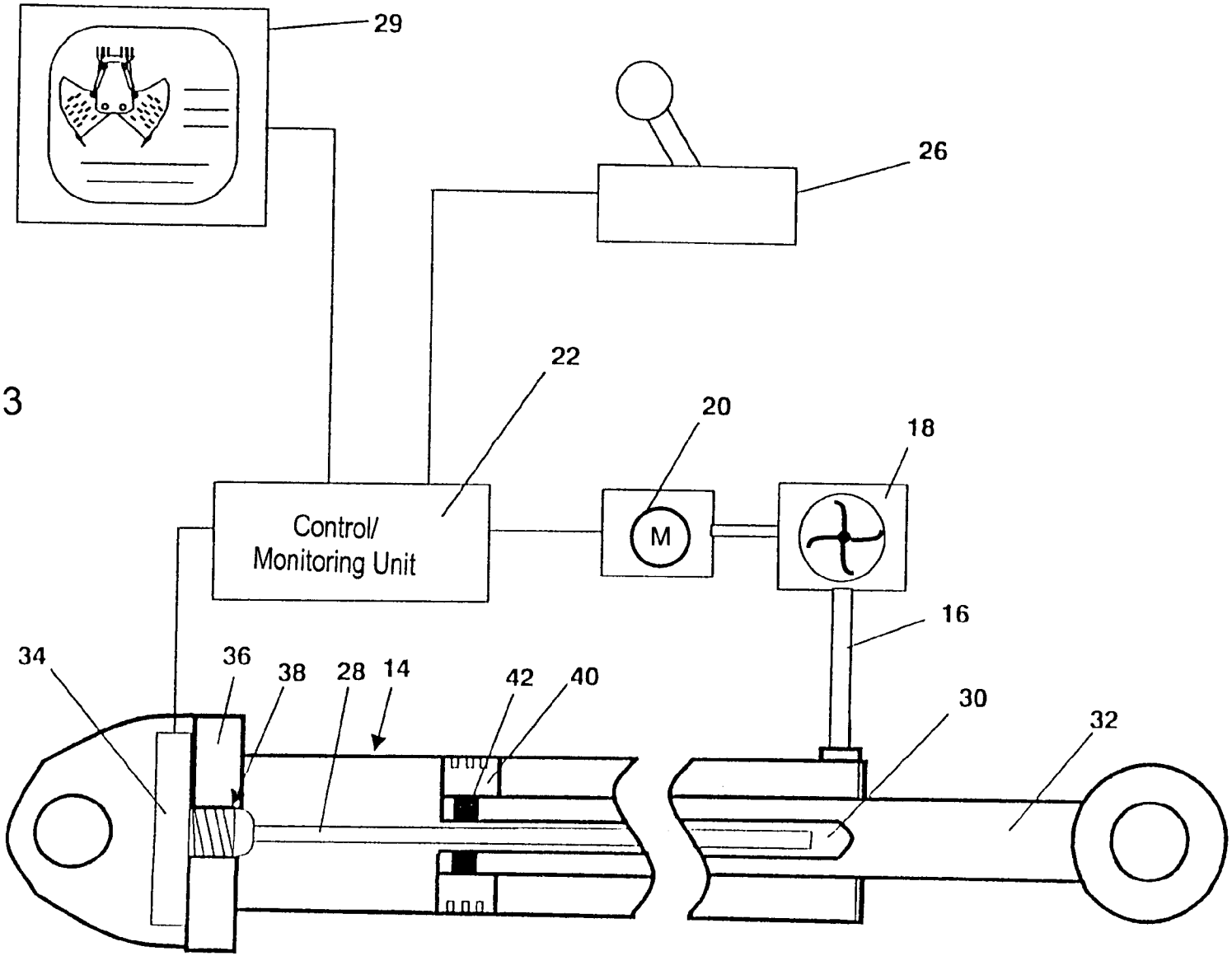
FIG. 3 is a schematic illustration of a hydraulic cylinder used in the hook-on grab bucket according to the invention together with the associated control and monitoring device, hydraulic pump, hydraulic motor, control unit, and display unit.

As can be gathered in detail from the illustration of FIG. 3, each of the hydraulic cylinders 14 is fed via an associated hydraulic line 16 by a hydraulic pump 18 which is driven in a known manner by an electric motor 20. The motor 20 is controlled by an electronic control and monitoring device 22. For illustrative reasons, the hydraulic cylinder 14 is illustrated in FIG. 3 as a cylinder acting on one side. It will be understood that the cylinder 14 may also be configured as a double action cylinder.

The electronic control and monitoring device 22 obtains its positioning signals for opening and closing the first and second half-scoops 6, 8 from a control unit 26, for example a control lever which is coupled to a potentiometer and is disposed together with a display unit 29 in the driver's cab of the excavator.

According to the invention, a sensor is disposed in at least one of the hydraulic cylinders 14, the sensor comprising a rod-shaped sensor element 28 which extends with its one end into a corresponding hole 30 in the piston rod 32 of the hydraulic cylinder 14. The rod-shaped sensor element 28 is fastened with its other end to a sensor head or measuring pickup 34 which extends through a hole 38, which is formed in the end-side housing 36 of the hydraulic cylinder 14, into the interior of the hydraulic cylinder 14.

Situated in the region of the piston 40, which is connected to the piston rod 32, is a positioning magnet 42 which is preferably integrated in the base of the piston and, by interaction of the magnetic field of an electric current flowing through the bar-shaped sensor element 28 with the magnetic field of the positioning magnet 42, generates a torsion pulse which propagates as a mechanical wave at a known speed, which is characteristic of the material of the bar-shaped sensor element 28, in the direction of the sensor head 34, and is converted by the latter into an actuating-travel signal corresponding to the propagation time and therefore into an actuating-travel signal corresponding to the distance between the sensor head 34 and positioning magnet 42. From the magnitude of the actuating-travel signal, which is essentially proportional to the distance between the sensor head 34 and the positioning magnet 42—and therefore to the actuating travel of the piston rod 32 within the hydraulic cylinder 14, the electronic control and monitoring device 22 determines the opening angle of the first and second half-scoops 6, 8, preferably by means of conversion of the data into associated digital signals.

According to the preferred embodiment of the invention, in this case the electronic control and monitoring device 22 compares the opening angle of the half-scoops 6, 8 with a predefined desired value for the actuating position of the half-scoops, which value is stored in the control and monitoring device 22, and corrects the position of the half-scoops appropriately if the deviation between the opening angle and the predefined desired value exceeds a predefined threshold value. This enables the desired position, which is predefined via the control unit 26 by the excavator driver, for the opening angle of the half-scoops to be maintained with very great accuracy. The closed position of the grab bucket 1 is advantageously indicated, according to the illustration of FIG. 3, simultaneously on the display unit 29 by the control and monitoring device 22, so that the excavator driver can always monitor the current position of the first and second half-scoops 6, 8.

In a preferred embodiment of the invention, in which in each case two hydraulic cylinders 14 fitted with corresponding sensors act on each side of the first and second half-scoops 6, 8, the control and monitoring device 22 furthermore compares the signals of at least two, but preferably of all of the hydraulic cylinders 14 engaging on the two half-scoops, and controls the hydraulic pump 18, or the motor 20 for driving the hydraulic pump 18, in such a manner that, if an impermissibly great difference between the actuating travels of two cylinders 14 occurs, the piston rod 32 is moved back again in the opposite direction, or an emergency stop is initiated in order to prevent a distortion of the half-scoops 6, 8.

In the same manner, according to a further embodiment of the invention, the control and monitoring device 22 can determine, by means of a temporal differentiation of the actuating-travel signals of the four hydraulic cylinders 14, the actuating speed of each hydraulic cylinder 14, and can compare them with each other by means of an appropriate subtraction in order, when a predefined threshold value for the speed is exceeded, to stop the movement of the piston rod 32 by switching off the hydraulic pump or the like, so that damage to the half-scoops is prevented.

In an alternative embodiment, the grab bucket may also be in the form of a so-called cactus grab or cactus poly grab or a spider grab bucket. Such a grab bucket is similar to the illustrated two-scoop bucket, but it has more scoops. A cactus grab bucket has a split and hinged bucket fitted with curved jaws or teeth.

This application claims the priority, under 35 U.S.C. § 119, of German utility model application No. 203 10 240.1, filed Jul. 3, 2003; the entire disclosure of the prior application is herewith incorporated by reference.

I claim:

1. A hook-on grab bucket, comprising:

first and second half-scoops movably disposed relative to one another between an open position and a closed position;

an hydraulic cylinder for moving said first and second half-scoops between the open position and the closed position;

a sensor disposed to monitor an opening angle of said half-scoops, said sensor being integrated in said hydraulic cylinder and generating an actuating-travel signal corresponding to an actuating travel of said hydraulic cylinder; and a control and monitoring device connected to said sensor.

2. The hook-on grab bucket according to claim 1, which further comprises a motor for driving said hydraulic cylinder.

3. The hook-on grab bucket according to claim 1, wherein said sensor is a magnetostrictive sensor.

4. The hook-on grab bucket according to claim 3, wherein said hydraulic cylinder has a piston rod, and said sensor comprises a bar-shaped sensor element and a positioning magnet, said bar-shaped sensor element running within said piston rod of said hydraulic cylinder and said positioning magnet being held on said piston rod and moving together with said piston rod.

5. The hook-on grab bucket according to claim 1, wherein said control and monitoring device is configured to compare the opening angle of said half-scoops with a predefined setpoint value and to correct an actuating position of said half-scoops if a deviation between the opening angle and the predefined setpoint value exceeds a predefined threshold value.

6. The hook-on grab bucket according to claim 1, wherein said control and monitoring device is configured to calculate the opening angle of said half-scoops from the actuating-travel signal of said sensor.

7. The hook-on grab bucket according to claim 1, wherein said hydraulic cylinder is one of two hydraulic cylinders with sensors disposed therein, and each of said half-scoops is respectively assigned at least one of said hydraulic cylinders.

8. The hook-on grab bucket according to claim 7, wherein said control and monitoring device is configured to compare the actuating-travel signals of said two hydraulic cylinders assigned to each of said two half-scoops with one another, and to stop a movement of said half-scoops into the closed position if a difference between the respective actuating-travel signals exceeds a predefined threshold value.

9. The hook-on grab bucket according to claim 7, wherein said control and monitoring device is configured to determine from the actuating-travel signals of said two hydraulic cylinders associated actuating speeds of said hydraulic cylinders and to stop a movement of said half-scoops into the closed position if a difference between the respective actuating speeds of said two hydraulic cylinders exceeds a predefined threshold value of if one of the actuating speeds drops below a predefined minimum value for the actuating speed.

10. The hook-on grab bucket according to claim 9, wherein said control and monitoring device is configured to generate an optical or acoustic indication signal if a movement of said half-scoops has stopped.

11. The hook-on grab bucket according to claim 8, wherein said control and monitoring device is configured to generate an optical or acoustic indication signal if a movement of said half-scoops has stopped.

12. The hook-on grab bucket according to claim 1, which comprises a display unit connected to said control and monitoring device, for optically illustrating at least one of the actuating position and actuating speed of said half-scoops.

* * * * *